US007876048B2

(12) United States Patent
Park

(10) Patent No.: US 7,876,048 B2
(45) Date of Patent: Jan. 25, 2011

(54) PLASMA DISPLAY PANEL WITH REDUCED POWER CONSUMPTION AND ENHANCED LUMINANCE

(75) Inventor: Jung-Tae Park, Yongin-si (KR)

(73) Assignee: Samsung SDI Co., Ltd. (KR)

( * ) Notice: Subject to any disclaimer, the term of this patent is extended or adjusted under 35 U.S.C. 154(b) by 334 days.

(21) Appl. No.: 12/070,623

(22) Filed: Feb. 19, 2008

(65) Prior Publication Data

US 2009/0015161 A1 Jan. 15, 2009

(30) Foreign Application Priority Data

Feb. 22, 2007 (KR) ..... 10-2007-0017862

(51) Int. Cl.
*H01J 17/49* (2006.01)

(52) U.S. Cl. ..... 313/586; 313/567; 313/581; 313/582; 313/583; 313/584; 313/585

(58) Field of Classification Search ..... None
See application file for complete search history.

(56) References Cited

U.S. PATENT DOCUMENTS 6,184,163 B1 * 2/2001 Lee et al. ..... 501/32
6,194,333 B1 * 2/2001 Ryu ..... 501/32
6,605,834 B1 * 8/2003 Lee ..... 257/295
6,777,872 B2 * 8/2004 Aoki et al. ..... 313/582
7,431,627 B2 * 10/2008 Oida et al. ..... 445/24
2003/0108753 A1 * 6/2003 Fujii et al. ..... 428/469
2008/0067938 A1 * 3/2008 Kim et al. ..... 313/586

FOREIGN PATENT DOCUMENTS

JP 2002-358895 12/2002
KR 102006007625 A 7/2006

* cited by examiner

*Primary Examiner*—Nimeshkumar D Patel
*Assistant Examiner*—Natalie K Walford
(74) *Attorney, Agent, or Firm*—Knobbe Martens Olson & Bear LLP

(57) ABSTRACT

The present embodiments provide a plasma display panel includes first and second substrates facing each other, barrier ribs dividing a plurality of discharge cells between the first and second substrates, phosphor layers coated in the discharge cells, display electrodes extending in a first direction corresponding to the discharge cells between the first and second substrates, address electrodes arranged on the first substrate corresponding to the discharge cells and extending in a second direction crossing the first direction, and a dielectric layer formed on the first substrate while covering the address electrodes. Each of the address electrodes includes an insulating glass layer formed along a periphery of the electrode. The dielectric layer includes $TiO_2$ within a range of 5-15% by weight.

14 Claims, 8 Drawing Sheets

PLASMA DISPLAY PANEL WITH REDUCED POWER CONSUMPTION AND ENHANCED LUMINANCE

CROSS-REFERENCE TO RELATED APPLICATION

This application claims priority to and the benefit of Korean Patent Application No. 10-2007-0017862 filed in the Korean Intellectual Property Office on Feb. 22, 2007, the entire content of which is incorporated herein by reference.

BACKGROUND OF THE INVENTION

1. Field of the Invention

The present embodiments relate to a plasma display panel and, more particularly, to a plasma display panel that reduces power consumption and enhances luminance.

2. Description of the Related Art

A plasma display panel (PDP) is a display device that can display an image using red (R), green (G), and blue (B) visible light created by exciting phosphors using vacuum ultraviolet (VUV) rays emitted from plasma generated by a gas discharge.

The PDP can realize a large-sized screen over 60 inches with a thickness less than 10 cm. Like a cathode ray tube (CRT), the PDP is also a self-emissive display device. Therefore, the PDP has an excellent color reproduction and has no image distortion viewed from any angle. Furthermore, the PDP utilizes a simple manufacturing process compared to that of a liquid crystal display (LCD) and thus has advantages in terms of manufacturing cost and productivity. As a result, the PDP has experienced widespread use both as an industrial flat panel display and as a television for the home.

A structure of the PDP has been developed since the 1970's, and at present the typical structure is an alternating current (AC) three-electrode surface-discharge plasma display.

In the AC three-electrode surface-discharge plasma display panel, a pair of electrodes is formed on a front substrate in a state facing each other. Address electrodes are provided on a rear substrate spaced apart from the front substrate.

A plurality of discharge cells, defined by barrier ribs, are disposed between the front and rear substrates. The discharge cells are formed along intersecting regions of display electrodes and address electrodes.

Furthermore, a phosphor layer is formed in the discharge cells and a discharge gas is injected into the discharge cells. The injected discharge gas creates discharge in the discharge cells along a pattern of an applied voltage through electrodes. Visible light is then emitted while ultraviolet rays, generated by the discharge, collide with the phosphor layer formed on the discharge cell.

The PDP having the AC three-electrode surface-discharge structure selects the discharge cells that will be turned on using a memory property of wall charges. The image is displayed by discharging the selected discharge cell.

Recently, the PDPs in the market have had a 50-high-definition (HD) grade resolution (1366×768), but ultimately it will be necessary to have a full-HD grade resolution (1920×1080).

In order to display a full-HD grade image by the PDP, it is necessary to form a higher density of the discharge cells that form a unit pixel, and accordingly, to form finer width and space of electrodes.

However, if the higher density is realized in the PDP, power consumption increases thereby deteriorating discharge efficiency and luminance.

Generally, if the PDP having the 50 HD (1366×768) is realized to the full-HD (1920×1080) of a same size, the discharge efficiency is reduced by about 30%. Furthermore, a line number of the address electrodes, that corresponds to the cells having the higher density, increases as well, thereby increasing an address power consumption.

Therefore, it is necessary to reduce permittivity of a lower dielectric layer that covers the address electrodes in order to reduce the power consumption of reactive components and to increase whiteness for enhancing a reflective luminance from a lower dielectric substance.

SUMMARY OF THE INVENTION

The present embodiments provide a plasma display panel (PDP) that reduces power consumption and enhances brightness.

The PDP of the present embodiments includes first and second substrates, barrier ribs defining discharge cells between the first and second substrates, a phosphor layer coated on each of the discharge cells, a display electrode formed along a first direction such that it corresponds to each of the discharge cells between the first and second substrates, an address electrode formed along a second direction intersecting the first direction such that the address electrode corresponds to each of the discharge cells on the second substrate, and a dielectric layer covering the address electrode on the second substrate, The address electrode includes an insulating glass layer formed along an edge connected to the second substrate. The dielectric layer includes $TiO_2$ within a range of 5-15% by weight.

The insulating glass layer may be formed in a band-shape which is extended along the edges of the address electrodes.

The address electrode includes a metal layer which may be coplanar to the insulating glass layer.

The insulating glass layer is formed adjacent to the metal layer. A surface of the insulating glass layer may connect at an angle from an edge of a surface of the metal layer to a surface of the second substrate.

The metal layer may include a silver powder. The insulating glass layer may be formed of a frit.

A first electrode may include a metal powder and frit. The metal powder may be included within a range of 52-62 part by weight and the frit may be included within a range of 5-15 part by weight.

The frit may include $B_2O_3$ and BaO, in which a weight ratio of BaO to $Ba_2O_3$ ($BaO/Ba_2O_3$) is bigger than 1. The dielectric layer may be formed of a non-lead dielectric substance.

DETAILED DESCRIPTION OF THE EMBODIMENTS

The present embodiments will now be described more fully with reference to the accompanying drawings, in which exemplary embodiments are shown. The embodiments may, however, be embodied in many different forms and should not be construed as being limited to the embodiments set forth herein; rather these embodiments are provided so that this disclosure will be thorough and complete, and will fully convey the concept of the embodiments to those skilled in the art. Wherever possible, the same reference numbers will be used throughout the drawings to refer to the same or like part.

Figure 1:
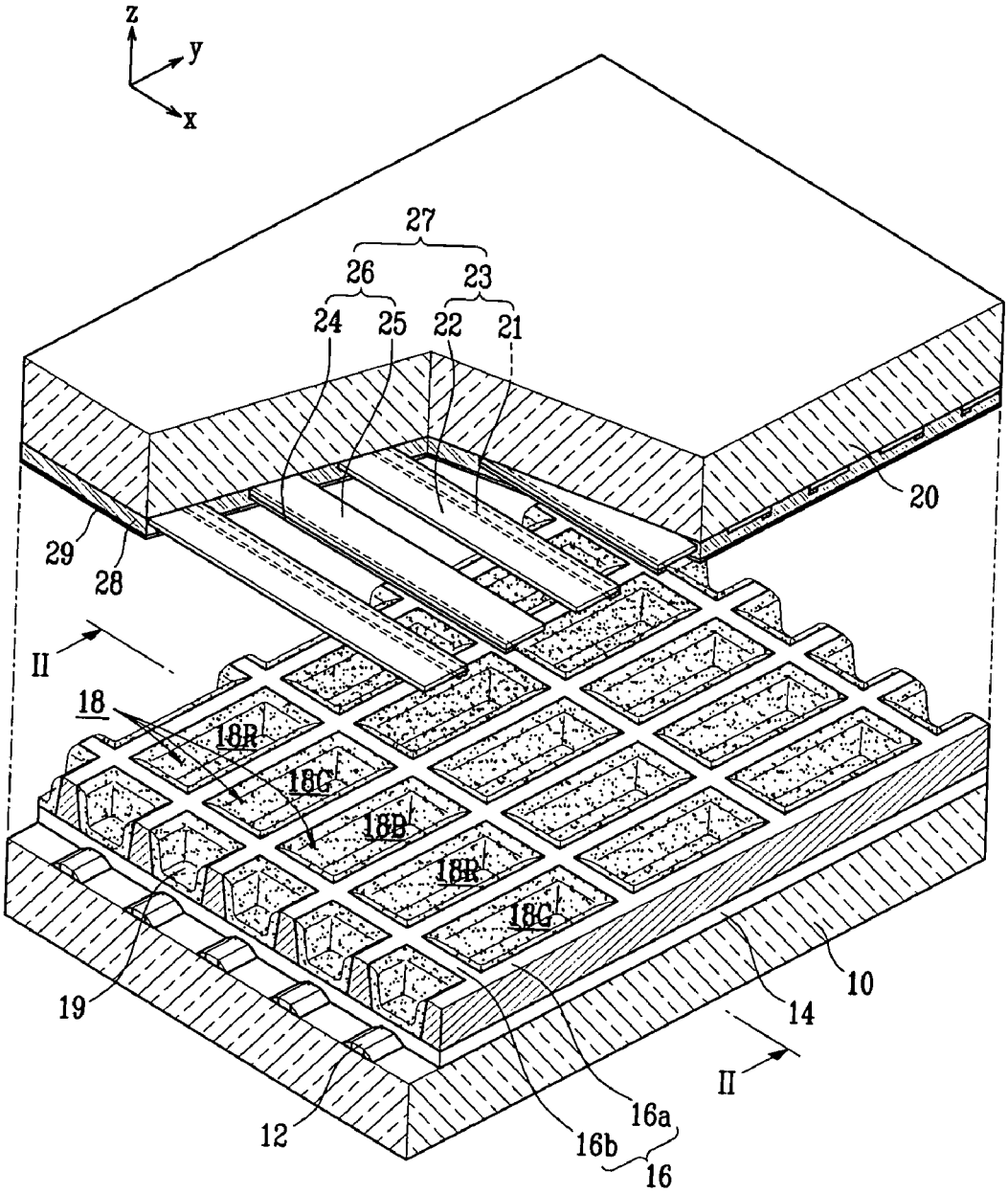
FIG. 1 is a fragmentary exploded perspective view of a plasma display panel (PDP) according to an embodiment.
Figure 2:
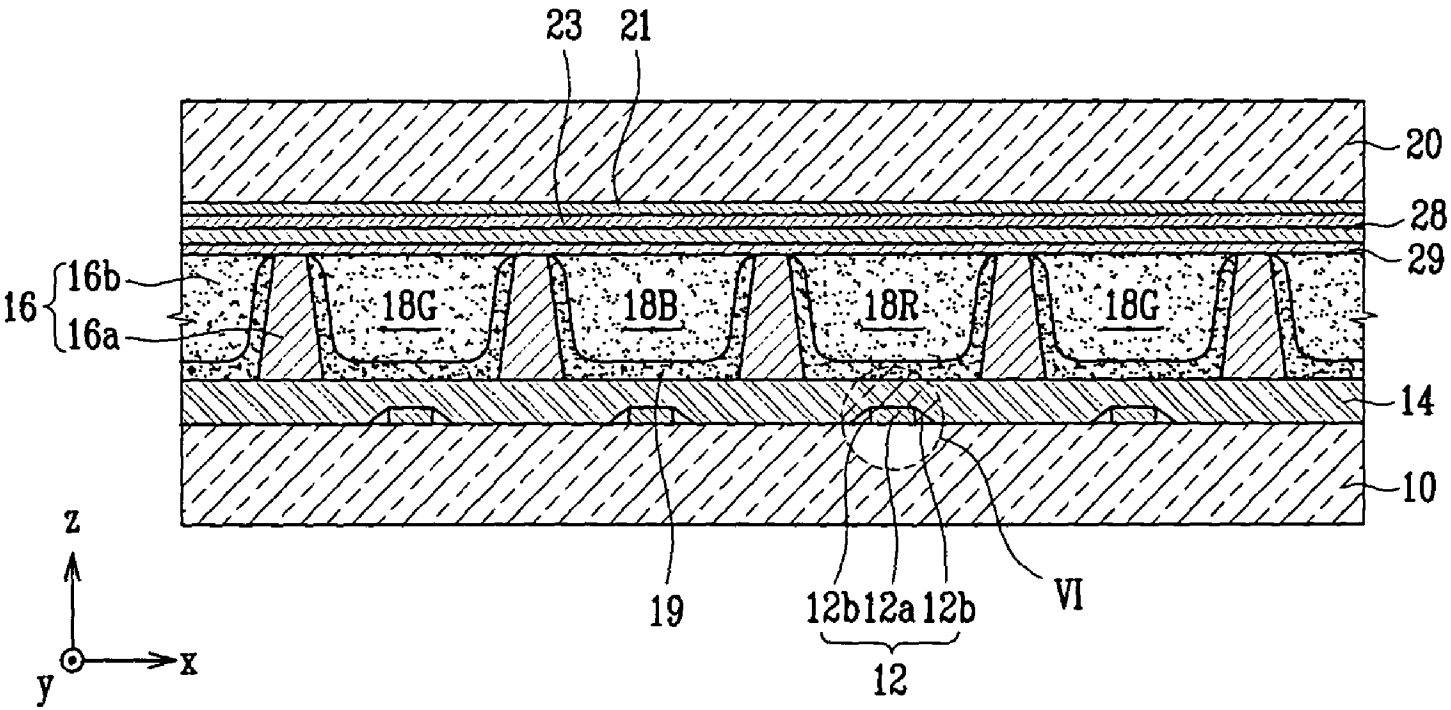
FIG. 2 is a side sectional view taken along line II-II of FIG. 1.

FIG. 1 is a fragmentary exploded perspective view of a plasma display panel (PDP) according to an embodiment, and FIG. 2 is a side sectional view taken along line II-II of FIG. 1

Referring to FIG. 1, according to the present embodiments, a plasma display panel (PDP) includes first and second substrates 10 and 20 (rear and front substrates, hereinafter) facing each other at a predetermined interval.

The rear and front substrates 10 and 20 are sealed together at their overlapping peripheries using a frit (not shown), thereby forming a sealed discharge space between the rear and front substrates 10 and 20. A plurality of discharge cells 18 are defined by barrier ribs 16 in the discharge space.

In this embodiment, the barrier ribs 16 are formed separately from the rear substrate 10, for example, by coating a barrier dielectric paste on the rear substrate 10 and subsequently baking after patterning.

The barrier ribs 16 include longitudinal barrier ribs 16*b* extending in a first direction (an x-axis in FIG. 1) and lateral barrier ribs 16*a* extending in a second direction (a y-axis in FIG. 1) perpendicularly crossing the longitudinal barrier ribs 16*b*. Therefore, the discharge cells 18, defined by the longitudinal and lateral barrier ribs 16*b* and 16*a*, are arranged in a matrix pattern.

However, the PDP of the present embodiments is not limited to what is described above. That is, in addition to the matrix pattern, the discharge cells 18 may be arranged in a variety of patterns such as a striped pattern or a delta pattern.

Display electrodes 27 are formed on the front substrate 20 extending in the first direction corresponding to the discharge cells 18. Each of the display electrodes 27 includes a pair of scan and sustain electrodes 23 and 26.

Each of the scan and sustain electrodes 23 and 26 respectively includes a bus electrode 21 and 24 extending along the corresponding longitudinal barrier rib 16*b*, and a transparent electrode 22 and 25 extending in the first direction and having a width from the corresponding bus electrode 21 and 24 toward a center of the corresponding discharge cell 18.

The transparent electrodes 22 and 25 are formed on the front substrate 20 in a stripe pattern extending in the first direction in order to correspond to the red (R), green (G), and blue (B) discharge cells 18 aligned along the first direction. The transparent electrodes 22 and 25 may be formed of transparent indium-tin oxide (ITO) in order to enhance a transmittance of visible light.

However, the display electrode 27 of the present embodiments is not limited to the configuration described above. For example, the transparent electrodes 22 and 25 may individually protrude from the bus electrodes 21 and 24 corresponding to the red, green, and blue discharge cells 18R, 18G, and 18B.

In order to compensate for a voltage drop caused by the transparent electrodes 21 and 24, the bus electrodes 21 and 24 are formed of a material excellent in conducting electricity. In order to increase the transmittance of the visible light, the bus electrode 21 and 24 are preferably respectively located close to the longitudinal barrier ribs 16*b* which are arranged between the corresponding discharge cells 18. Furthermore, the bus electrodes 21 and 24 may be located along the top of the longitudinal barrier ribs 16*b*, respectively.

A dielectric layer (upper dielectric layer, hereinafter) 28 is formed so that the upper dielectric layer 28 covers the scan and sustain electrodes 23 and 26 on the front substrate 20.

A protection layer 29 is formed on the upper dielectric layer 28 in order to prevent any damage caused by plasma discharge occurring in the discharge cells 18. The protection layer 29 may be, for example, an MgO layer having a relatively high visible light transmittance. The protection layer 29 protects the upper dielectric layer 28 and has a high secondary electron emission coefficient, thereby further reducing a firing voltage.

In addition, the address electrodes 12 are arranged corresponding to the discharge cells 18 respectively, and extend substantially parallel to the second direction on the rear substrate 10. Each of the address electrodes 12 includes a metal layer 12*a* and an insulating glass layer 12*b* which is coplanar and close to both edges of the metal layer 12*a*.

The metal and insulating glass layers 12*a* and 12*b* of the address electrodes 12 will be described more in detail hereinafter with reference to FIGS. 6 and 7.

Further, a dielectric layer (lower dielectric layer, hereinafter) 14 is formed on the rear substrate 10 such that the lower dielectric layer 14 covers the address electrodes 12.

The lower dielectric layer 14 may contain a Pb or Pb-free dielectric substance. For example, a Pb dielectric substance can include $PbO—Bi_2O_3—SiO_2$, and a Pb-free dielectric substance can include $ZnO—B_2O_3—B_2O_3$ or $Bi_2O_3—SiO_2—B_2O_3$.

However, for the lower dielectric layer 14, it is preferable to use the Pb-free dielectric substance which is more environmentally friendly compared to the Pb dielectric substance.

In the discharge cells 18, a phosphor layer 19 is formed on side walls of the barrier ribs 16 and a top of the lower dielectric layer 14. The phosphor layers 19 arranged along the second direction are formed of phosphors of the same color. The phosphor layers 19 arranged along the first direction are formed of red, green, and blue phosphors R, G, and B that are alternately placed.

In addition, each of the discharge cells 18, in which the red, green, and blue phosphors R, G, and B are formed, is filled with a discharge gas, such as a gas mixture including neon (Ne) and xenon (Xe), to generate a plasma discharge.

Therefore, in this embodiment, when driving the PDP, the PDP has a reset discharge effected by a reset pulse applied to the scan electrode 23 during a reset period. While in a scan period following the reset period, an address discharge occurs by a scan pulse applied to the scan electrode 23 and an address pulse applied to an address electrode 12. Subsequently, a sustain discharge occurs by a sustain pulse applied to the sustain and scan electrodes 26 and 23.

Therefore, the sustain and scan electrodes 26 and 23 apply the sustain pulse for the sustain discharge, the scan electrodes 23 apply the reset and scan pulses, and the address electrodes 12 apply the address pulse. However, the sustain, scan, and address electrodes 26, 23, and 12 of the present embodiments are not limited in this respect, and the sustain, scan, and address electrodes 26, 23, and 12 may perform other roles depending on the voltage waveforms applied thereto.

Therefore, the PDP selects the discharge cells 18 that will be turned on by the address discharge occurring by the interaction between the address and scan electrodes 12 and 23, and drives the selected discharge cells 18 using the sustain discharge occurring by the interaction between the sustain and scan electrodes 23 and 26, thereby displaying an image.

In order to have a PDP realizing a full-HD image, the discharge cells 18 corresponding to unit pixels, are formed with a higher density, and the number of lines of display and the number of address electrodes 27 and 12 increases such that the display and address electrodes 27 and 12 correspond to the discharge cells 18 with a higher density.

Therefore, as the number of lines of the address electrode 12 increases, power consumption increases and this deteriorates discharge efficiency, thereby reducing a luminance.

Therefore, according to this embodiment, the content of $TiO_2$ in the lower dielectric layer 14 is increased such that the power consumption of reactive components is reduced by lowering the dielectric constant and the luminance is enhanced by increasing whiteness.

The whiteness, the dielectric constant, the power consumption, and a property of a withstanding voltage will be described hereinafter with a reference with FIGS. 3-5.

Figure 3:
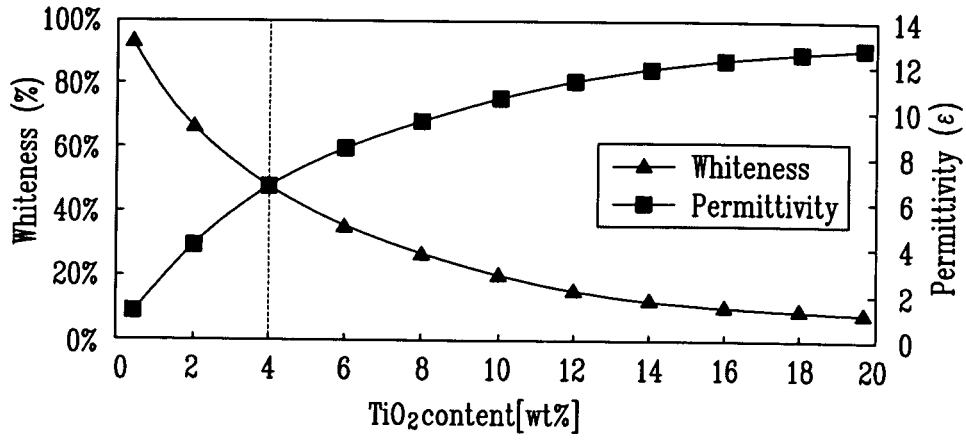
FIG. 3 is a graph illustrating a relation of whiteness and permittivity corresponding to a $TiO_2$ content of a lower dielectric substance of a PDP according to an embodiment.

FIG. 3 is a graph illustrating a relation of whiteness and permittivity to the $TiO_2$ content of a PDP according to an embodiment.

Referring to FIG. 3, as the content of $TiO_2$ in a dielectric layer 14 becomes higher, the dielectric constant of the dielectric layer 14 becomes lower. That is, when the content of $TiO_2$ in the dielectric layer 14 increases, the content of the dielectric substance decreases, thereby reducing the dielectric constant. Therefore, this reduces power consumption of reactive components by reducing the amount of charges unnecessarily stored in the dielectric layer 14.

Also, as the content of $TiO_2$ in the dielectric layer 14 becomes higher, the whiteness increases. This may reflect more visible light excited in discharge cells during a sustain discharge toward the front substrate 20, thereby enhancing luminance.

Figure 4:
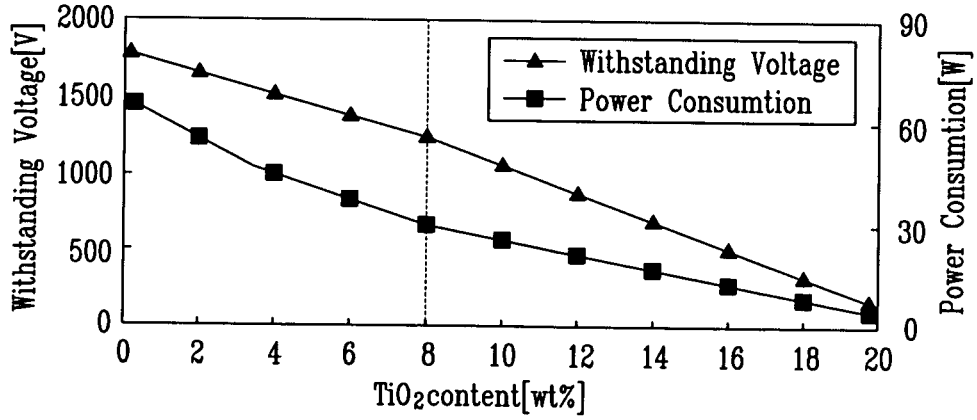
FIG. 4 is a graph illustrating a relation of a withstanding voltage and power consumption corresponding to a $TiO_2$ content of a lower dielectric substance of a PDP according to an embodiment.

FIG. 4 is a graph illustrating a relation of a withstanding voltage and power consumption to the $TiO_2$ content of a PDP according to an embodiment.

Referring to FIG. 4, as the content of $TiO_2$ of a dielectric layer 14 becomes higher, the power consumption is reduced, but the withstanding voltage of the lower dielectric layer 14 drops rapidly.

Therefore, when the withstanding voltage of the lower dielectric layer 14 drops, the lower dielectric layer 14 is damaged by a discharge voltage, thereby breaking down insulation between the address electrodes 12. Furthermore, a full-HD grade PDP that has a narrower space between the address electrodes 12 tends to have an insulation breakdown caused by withstanding such a voltage drop.

Therefore, in this embodiment, the lower dielectric layer 14 preferably has a $TiO_2$ content from about 5 to about 15% by weight ratio.

Figure 5:
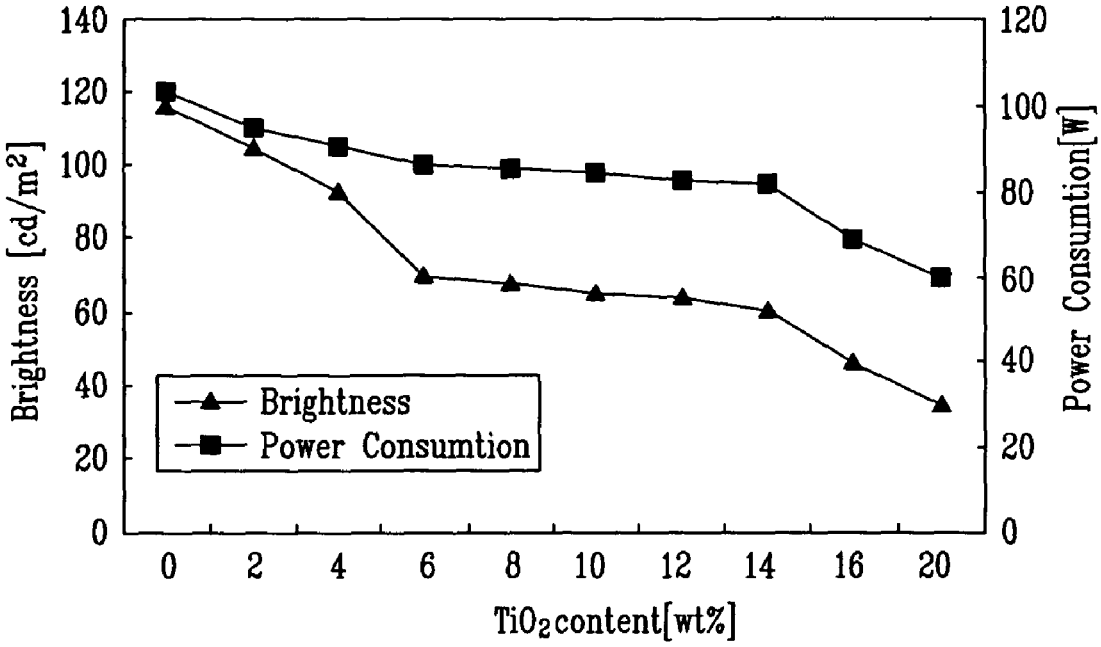
FIG. 5 is a graph illustrating a relation of brightness and power consumption corresponding to a $TiO_2$ content of a lower dielectric substance of a PDP according to an embodiment.

FIG. 5 is a graph illustrating the relationship of luminance and power consumption to the $TiO_2$ content of a PDP according to an embodiment.

The $TiO_2$ content of the lower dielectric layer 14 may be within from about 5 to about 15% by weight ratio in order to enhance the luminance and reduce the power consumption.

Further, in this embodiment, an insulation breakdown between the address electrodes 12 that is generated by a withstanding voltage drop caused by the increased $TiO_2$ content of the dielectric layer 14, is compensated for by an insulating glass layer formed along peripheries of the address electrodes 12.

Figure 6:
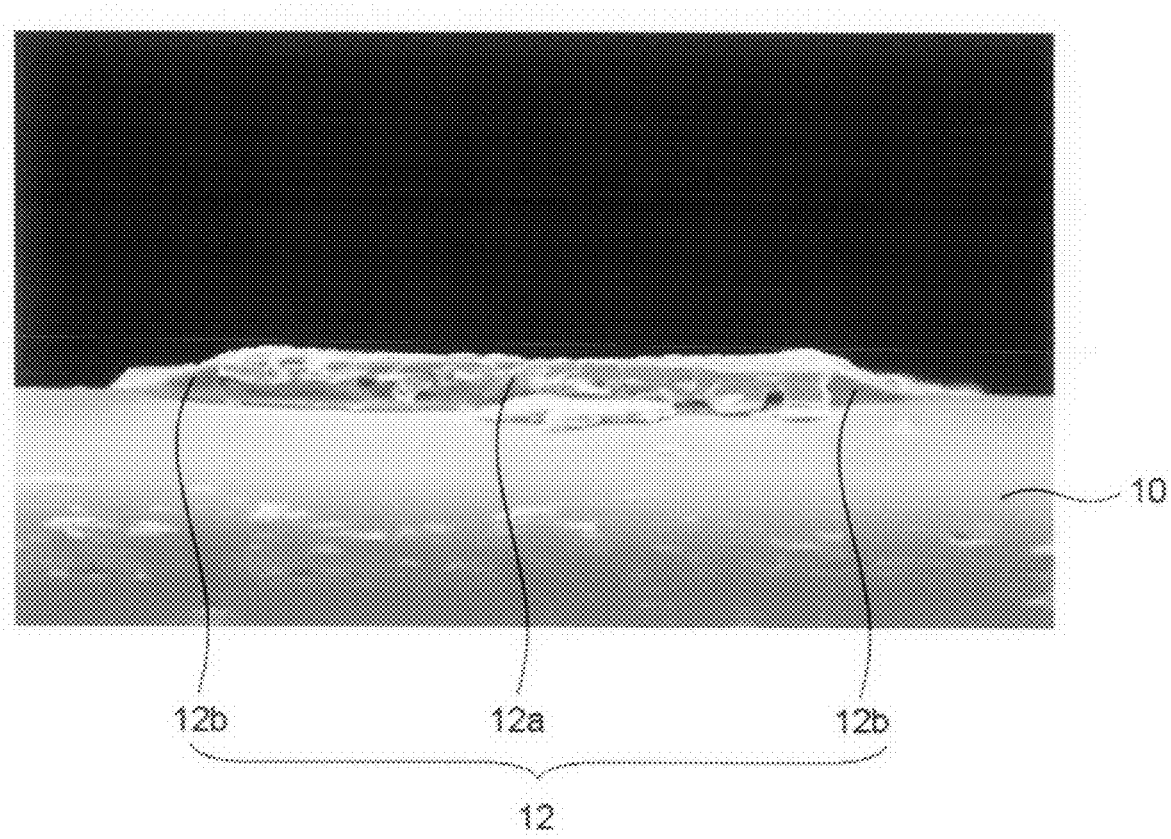
FIG. 6 is an enlarged picture of a portion VI of FIG. 2.
Figure 7:
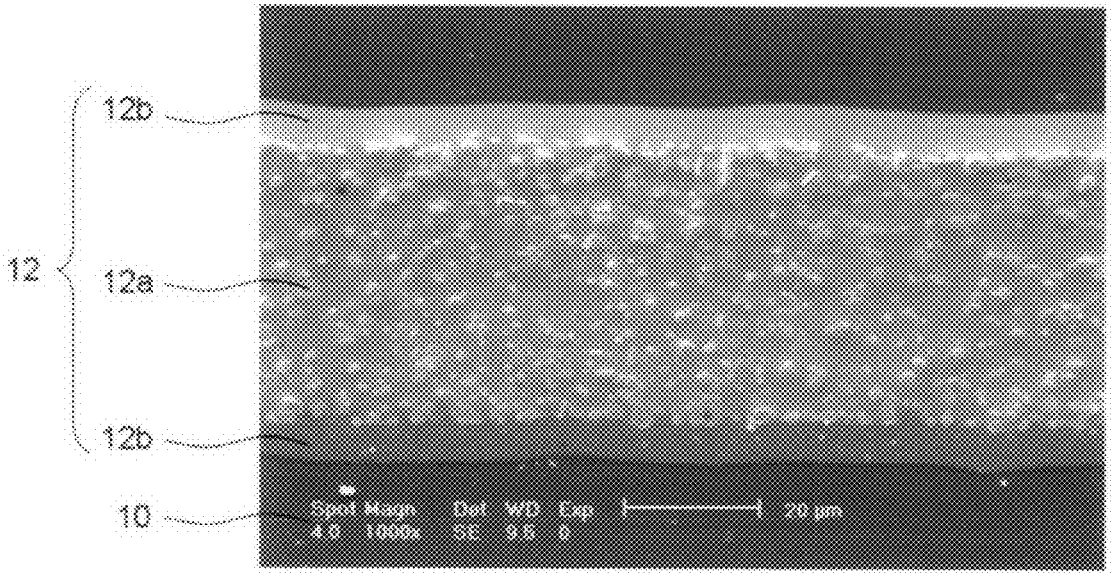
FIG. 7 is an enlarged picture of a planar shape of the address electrode of FIG. 6.

Referring to FIGS. 6 and 7, one of the address electrodes 12 will be described hereinafter in detail.

FIG. 6 is an enlarged picture of a portion VI of FIG. 2, and FIG. 7 is an enlarged picture of a planar shape of the address electrode of FIG. 6.

Referring to FIGS. 6 and 7, the address electrode 12 includes a metal layer 12*a* and an insulating glass layer 12*b* that is formed adjacent to both edges of the metal layer 12*a* and is coplanar therewith. The metal layer 12*a* is arranged along the second direction on the rear substrate 10, and forms an electric conductive layer in order to apply an address voltage to the corresponding discharge cell 18.

For example, the metal layer 12*a* may be formed of silver (Ag) which is relatively inexpensive and a good conductor. The metal layer 12*a* includes a silver powder, and the silver powder may be a paste. The silver paste is calcinated in a baking process while shaped by a frit, thereby having an electrode shape.

The insulating glass layer 12*b* is formed as a band-shape along the both edges of the coplanar metal layer 12*a* in the second direction. A surface (top surface) of the insulating glass layer 12*b* connects at an angle from an edge of a surface of the metal layer 12*a* to a surface of the rear substrate 10. Therefore, the insulating glass layer 12*b* includes an insulation layer that insulates both edges of the metal layer 12*a*.

The insulating glass layer is mostly formed of frit. That is, the metal layer 12*a* is formed mostly of a metal powder shaped by frit, and the insulating glass layer 12*b* is mostly formed of frit thereby forming a single piece with the metal layer 12*a* while being distinguished from each other.

The address electrode includes the metal powder of the metal layer 12*a* within a range of about 52 to about 62 parts by weight and the frit within a range of about 5 to about 15 parts by weight.

Further, the frit includes $B_2O_3$ and BaO as constituents, and the weight ratio of BaO to $B_2O_3$ is within a range of from 1 to about 5. The frit is mixed with the metal powder to help bond together the metal particles As described above, in the address electrode of this embodiment, the insulating glass layer 12*b* insulates both edges of the metal layer 12*a*. Therefore, the insulating glass layer 12*b* may prevent the insulation breakdown by the withstanding voltage that is dropped by the increased content of $TiO_2$ of the lower dielectric layer.

A structure of the address electrode 12 described hereinabove may be formed by a composition of a compound for forming an electrode in a manufacturing process described hereinafter.

FIG. 8A through 8D are a schematic views illustrating sequential processes involved in manufacturing an address electrode according to an embodiment.

Referring to FIG. 8A through 8D, a manufacturing process of a rear substrate of this embodiment includes forming an electrode layer 52, ST1, exposing and developing the electrode layer 52, ST2 and ST3, and a baking process ST4.

Figure 8A:
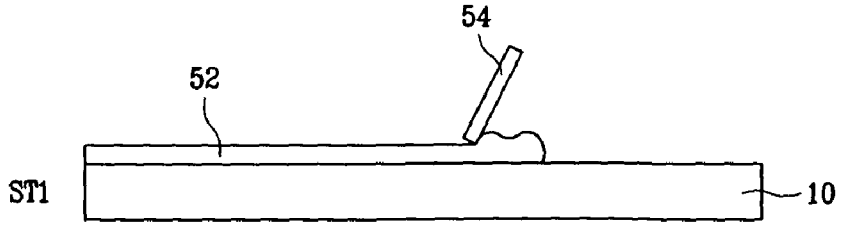
FIG. 8A through 8D are a schematic views illustrating sequential processes involved in manufacturing an address electrode according to an embodiment.

Referring to FIG. 8A, the forming of the electrode layer ST1 is implemented by coating a paste of a compound for forming an electrode on the rear substrate 10 using a squeezer 54 and subsequently drying the coated paste to form the electrode layer 52.

In this embodiment, the paste of the compound for forming the electrode includes a metal powder, a frit, and a vehicle. Preferably, the content of the metal powder and the frit is within a weight ratio range of the metal power to the frit of from about 52 to about 62:from about 5 to about 15.

As described hereinabove, the metal powder may be silver (Ag), as an example. Silver has a conductivity that is not deteriorated by oxidation while baked in atmosphere and is a relatively inexpensive electrode material.

The metal powder is not limited to any particular shape, and may be granular-shaped, sphere-shaped, or flake-shaped. However, considering the light property and dispersion, it is preferable to use a sphere-shape alone or a combination thereof.

Further, during the baking process, the frit solidifies and the metal powder has an electrode shape, and forms an insulating glass layer 12*b* on a periphery of the electrode.

The frit provides an adhesive force between the metal powder and substrates. Preferably, the frit includes at least one of $SiO_2$, PbO, $Bi_2O_3$, ZnO, $B_2O_3$, and BaO.

In order to lower a glass transition temperature, the weight ratio of BaO to $B_2O_3$ to is bigger than about 1, preferably within a range of about 1 to about 5.

The vehicle includes an organic solvent and a binder.

The organic solvent may be one typically used in the art, for example, ketones such as diethylketone, methylbutylketone, dipropylketone, and cyclohexanone; alcohols such as n-pentanol, 4-methyl-2-pentanol, cyclohexanol, and diacetone alcohol; alcohol ethers such as ethylene glycol monomethyl ether, ethylene glycol monoethyl ether, ethylene glycol monobutyl ether, propylene glycol monomethyl ether, propylene glycol monoethyl ether; saturated aliphatic monocarboxylic alkyl esters such as n-butyl acetate and amyl acetate; lactic esters such as ethyl lactate and n-butyl lactate; ether esters such as methyl cellosolve acetate, ethyl cellosolve acetate, propylene glycol monomethyl ether acetate, ethyl-3-ethoxypropionate, and 2,2,4-trimethyl-1,3-pentadiol mono (2-methylpranoate); or a combination thereof.

A polymer may be used for the binder, which may be cured by a photo-initiator and removed by the developing process while forming an electrode. A polymer typically used in the art for a photo-resist may be used such as acrylate resin, styrene resin, novolak resin, or polyester resin. Preferably, the polymer is a copolymer that is polymerized with a monomer having a carboxylic group selected from a group consisting of monomer (i), monomer (ii), monomer (iii) (defined below), and a combination thereof.

Monomer (i): Monomers Having A Carboxylic Group

Examples of monomers having a carboxylic group include acrylic acid, methacrylic acid, maleic acid, fumaric acid, crotonic acid, itaconic acid, citric acid, mesaconic acid, cinnamic acid, mono((2-(meth)acryloyloxyethyle) succinate, or ω-carboxyl-polycarprolactone monoacrylate.

Monomer (ii): Monomers Having An OH Group

Examples of monomers having an OH group include 2-hydroxyethyl methacrylate, 2-hydroxypropyl methacrylate, and 3-hydroxypropyl methacrylate; or, monomers having a phenol group such as o-hydroxy styrene, m-hydroxy styrene, or p-hydroxy styrene.

Monomer (iii): Other Monomers That May Be Copolymerized

Examples of other monomers that may be copolymerized include methacrylic esters excluding monomer (i), such as methyl methacrylate, ethyl methacrylate, n-butyl methacrylate, n-lauryl methacrylate, benzyl methacrylate, glycidyl methacrylate, and dicyclopentanyl methacrylate; aromatic vinyl monomers such as styrene, and o-methylstyrene; conjugated dienes, such as butadiene, isoprene; and, macromonomers having a polymerisable unsaturated group, such as a methacryl group, at one end of a polymer chain such as polystyrene, polymethylmethacrylate, polyethylmethacrylate and polybenzylmethacrylate.

Further, the binder may present a proper viscosity while coating the compound for forming the electrode on the substrate in order to form the metal layer 12*a*. Considering decomposition during the developing process described hereinafter, it is preferable to use a binder having a weight average molecular weight within a range of from about 5,000 to about 50,000 and an acid value within a range of from about 20 to about 100 mg KOH/g.

The content of the organic solvent and the binder may be controlled in order to have the proper viscosity of the compound for forming the electrode in the coating process.

In this embodiment, the compound for forming the electrode may include a curing agent and a photo-initiator.

The curing agent used is not limited to any particular type, as long as it may be initiated and polymerized by the photo-initiator. The curing agent may preferably be a multifunctional monomer, such as ethylene glycol diacrylate, ethylene glycol dimethacrylate, trimethylpropane triacrylate, trimethylpropane trimethacrylate, tetramethylpropane tetramethacrylate, pentaerythritol tetraacrylate, tetramethylpropane tetramethacrylate, or a combination thereof.

Preferably the curing agent is included with a predetermined ratio to the binder, and more preferably is within a range of from about 20 to about 150 parts by weight per 100 part by weight of the binder.

The photo-initiator produces radicals during the exposing process, which is not limited to any particular type of exposing process as long as it may initiate a curing reaction of the curing agent. For example, the photo initiator may be at least one of o-benzoylbenzoate, methyl 4,4-bis(dimethylamino) benzophenone, 2,2-diethoxyacetophenone, 2,2-dimethoxy-2-phenyl-acetophenone, 2-methyl-(4-methyl-thiophene)-2-morpholinopropan-1-one, 2-benzyl-2-dimethylamino-1-(4-morpholinophenyl)-1-butanone, 2,4-diethylthioxanthone, bis(2,6-dimethoxybenzoyl)-2,4,4-trimethyl-pentylphosphine oxide, and a combination thereof.

Further, preferably the photo-initiator is included with a predetermined weight ratio to the curing agent, and more preferably within a range of about 10 to about 50 parts by weight per 100 parts by weight of the curing agent.

In this embodiment, the compound for forming the electrode may include further additives corresponding to each purpose for them.

The additive may be a sensitizer that enhances sensitivity, an inhibitor and an anti-oxidant that improves conservation of the compound for forming the electrode, a UV absorber that enhances a resolution, a defoamer that reduces foam in the paste, a dispersing agent that enhances dispersion, a leveling agent that enhances roughness of a layer while developing, and a plasticizer that provides a thixotropy.

These additives may be used with proper adjustment of a conventional usage according to need, or may not be used at all.

Figure 8B:
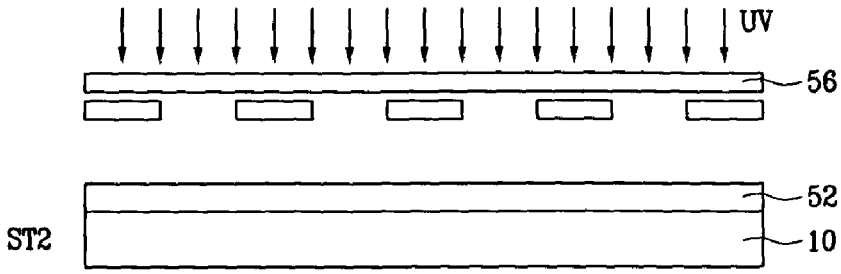

Referring to FIG. 8B, during the exposing process ST2, a mask 56 having an address electrode pattern is disposed on an electrode layer 52, and subsequently UV light is illuminated thereon.

Figure 8C:
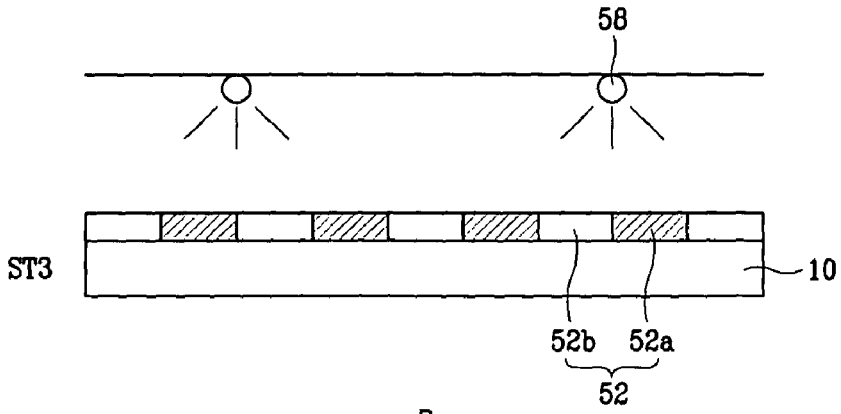

Referring to FIG. 8C, during the developing process ST3, a developing solution is injected. Subsequently, an unexposed region, excluding a region 52*a* exposed by the UV light in the exposing process, is etched and subsequently dried.

Figure 8D:
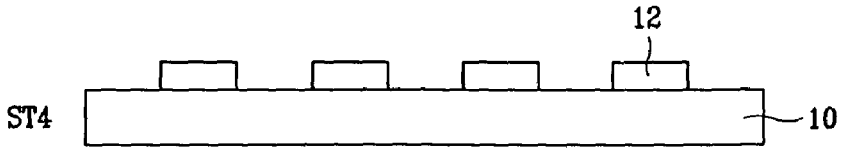

Referring to FIG. 8D, during a baking process ST4, an electrode region remaining from the electrode layer is baked, thereby forming the address electrode 12.

In the baking process, a vehicle including an organic solvent and a binder is removed from the compound for forming the electrode, thereby leaving a metal powder and a frit.

Therefore, the address electrode 12 is formed of the remained metal powder and frit. The metal powder forms a metal layer 12*a* at a center portion of the address electrode 12 while solidified by the frit. Also, the frit forms an insulating glass layer 12*b* at a region of both ends of the metal layer 12*a*, referring to FIGS. 6 and 7.

A mechanism where the frit forms the insulating glass layer 12*b* at the both ends of the metal layer 12*a* may be understood by a typical liquid-state sintering of ceramics.

During a particle rearrangement, which is a first process of the liquid-state sintering, the frit of the insulating glass layer 12*b* provides a drive force so that the silver powder forming the metal layer 12*a* travels easily between the silver powders. The frit generates a neck between the silver powders, which subsequently travels outward.

When the frit formed of glass travels out to a surface of the metal layer 12*a*, the amount of an open pore which only includes the silver powder may be reduced significantly. Further, the frit forms the insulating glass layer 12*b* at both edges of the metal layer 12*a*.

The insulating glass layer 12*b* insulates the both edges of the metal layer, thereby compensating for the insulation breakdown between the address electrodes, which is caused by the withstanding voltage drop corresponding to the increased content of $TiO_2$ of the lower dielectric layer.

During the baking process ST4, the insulating glass layer 12*b* may reduce shrinkage load occurring at edges of the metal layer 12*a* thereby preventing edge-curl which may lift up the edges of the metal layer.

Figure 9:
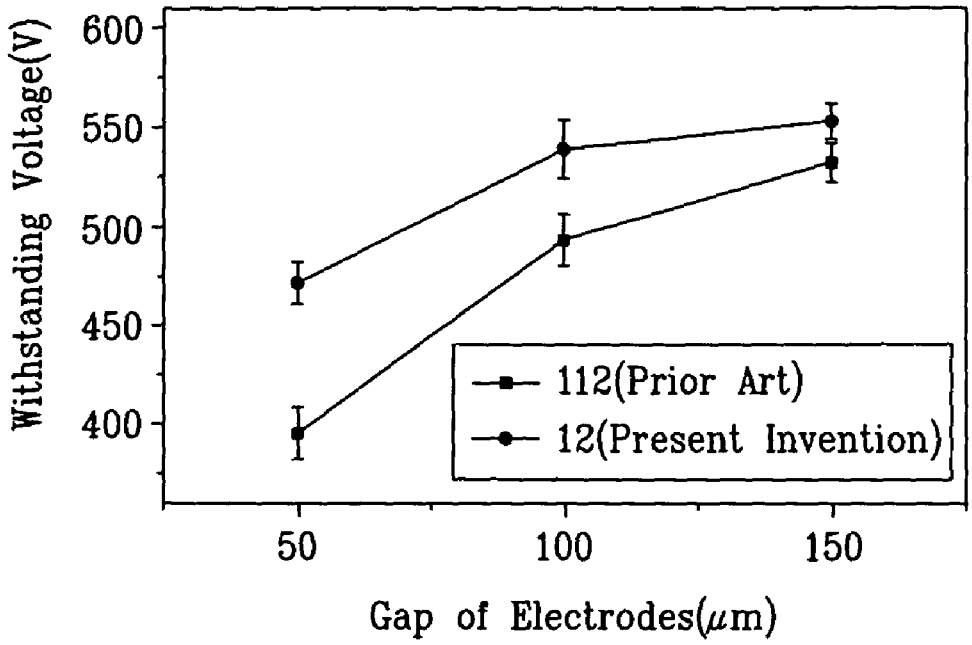
FIG. 9 is a graph illustrating a relation of a gap of electrodes and a withstanding voltage corresponding to a $TiO_2$ content of a lower dielectric substance of the PDP according to an embodiment.

FIG. 9 is a graph illustrating a relation of a gap between electrodes to a withstanding voltage according to a PDP of an embodiment.

Referring to FIG. 9, when a gap between the address electrodes becomes narrower, the withstanding voltage drops, thereby the tendency to have an insulation breakdown increases.

However, the address electrode 12 of the embodiment has an insulating glass layer 12*b* forming an insulation layer along edges of a metal layer 12*a*, thereby improving the withstanding voltage compared to a conventional address electrode 112.

Therefore, in this embodiment, the address electrode 12 may increase the withstanding voltage by forming the insulating glass layer 12*b*, which may increase the content of $TiO_2$ of a lower dielectric layer 14 within a range of about 5 to about 15 parts by weight, thereby reducing power consumption and enhancing luminance.

As described hereinabove, according to the present embodiments, a PDP includes a metal powder and a frit within a range of weight ratio of the metal powder to the frit of 52-62:5-15, thereby compensating for a withstanding voltage between electrodes. Therefore, a content of $TiO_2$ of a dielectric layer may be increased within a range of about 5 to about 15% by weight, thereby reducing power consumption and enhancing luminance.

Although exemplary embodiments have been described in detail hereinabove, it should be clearly understood that many variations and/or modifications of the basic inventive concept taught herein fall within the spirit and scope of the present embodiments, as defined by the appending claims.

What is claimed is:

1. A plasma display panel comprising:

a first and second substrate facing each other;

barrier ribs defining a plurality of discharge cells between the first and second substrates;

phosphor layers coated in the discharge cells;

display electrodes extending in a first direction corresponding to the discharge cells between the first and second substrates:

address electrodes arranged on the first substrate corresponding to the discharge cells and extending in a second direction intersecting the first direction;

a dielectric layer formed on the first substrate which covers the address electrodes, wherein each of the address electrodes comprises an insulating glass layer formed along a periphery of the address electrode, and wherein the dielectric layer comprises $TiO_2$ within a range of about 5 to about 15% by weight wherein the insulating glass layer is formed of a frit, and wherein the fit comprises $B_2O_3$ and BaO, wherein the weight ratio of the BaO to the $B_7O_3$ is greater than about 1.

2. The plasma display panel of claim 1, wherein the insulating glass layer is formed as a band-shape along a periphery of the address electrode.

3. The plasma display panel of claim 1, wherein the address electrode further comprises a metal layer and wherein the insulating glass layer is formed coplanar to the metal layer.

4. The plasma display panel of claim 3, wherein the insulating glass layer is formed adjacent to the metal layer and connected at an angle from an edge of a surface of the metal layer to a surface of the first substrate.

5. The plasma display panel of claim 3, wherein the metal layer comprises a silver powder.

6. The plasma display panel of claim 3, wherein the address electrode comprises a metal powder and a frit, wherein the metal powder consitutes from about 52 to about 62% by weight and the frit constitutes from about 5 to about 15% by weight of the electrode.

7. The plasma display panel of claim 5, wherein the address electrode comprises a metal powder and a fit, wherein the metal powder consitutes from about 52 to about 62% by weight and the frit constitutes from about 5 to about 15% by weight of the electrode.

8. The plasma display panel of claim 1, wherein the address electrode further comprises a metal layer, wherein the frit comprises $B_2O_3$ and BaO wherein the weight ratio of the BaO to the $B_2O_3$ is from about 1 to about 5.

9. The plasma display panel of claim 1, wherein the dielectric layer is formed of a Pb-free dielectric substance.

10. The plasma display panel of claim 9, wherein the Ph-free dielectric substance comprises at least one of ZnO—$Bi_2O_3$—$B_2O_3$ and $Bi_2O_3$—$SiO_2$—$B_2O_3$.

11. The plasma display panel of claim 1, further comprising a protection layer.

12. The plasma display panel of claim 11, wherein the protection layer comprises MgO.

13. A method of manufacturing the first substrate of claim 1, comprising:

forming an electrode layer, exposing and developing the electrode layer, and baking the electrode layer.

14. A method of manufacturing the plasma display panel of claim 1, comprising:

combining the first substrate of claim 13 with the second substrate.

* * * * *

UNITED STATES PATENT AND TRADEMARK OFFICE

CERTIFICATE OF CORRECTION

PATENT NO. : 7,876,048 B2
APPLICATION NO. : 12/070623
DATED : January 25, 2011
INVENTOR(S) : Park It is certified that error appears in the above-identified patent and that said Letters Patent is hereby corrected as shown below:

| Issued Patent | | Description of Discrepancy |
|---|---|---|
| **Column** | **Line** | |
| 3 | 31 | Change "FIG. 1" to --FIG. 1.--. |
| 6 | 50 | Change "particles" to --particles.--. |
| 7 | 49 (Approx.) | Change "novolak" to --novolac--. |
| 7 | 60 (Approx.) | Change "polycarprolactone" to --polycaprolactone--. |
| 8 | 10 | Change "polymerisable" to --polymerizable--. |
| 10 | 29 (Approx.) | In Claim 1, Change "fit" to --frit--. |
| 10 | 30 (Approx.) | In Claim 1, change "$B_7O_3$" to --$B_2O_3$--. |
| 10 | 47 (Approx.) | In Claim 6, change "consitutes" to --constitutes--. |
| 10 | 51 (Approx.) | In Claim 7, change "fit," to --frit,--. |
| 10 | 52 (Approx.) | In Claim 7, change "consitutes" to --constitutes--. |
| 10 | 61-62 | In Claim 10, change "Ph-free" to --Pb-free--. |

Signed and Sealed this
Thirtieth Day of August, 2011

David J. Kappos

David J. Kappos
*Director of the United States Patent and Trademark Office*